United States Patent [19]

Henig

[11] Patent Number: 4,941,960

[45] Date of Patent: Jul. 17, 1990

[54] BARREL FOR ELECTROPLATING, PHOSPHATING AND PICKLING

[76] Inventor: Hans Henig, Albrecht-Achilles-Strasse 48, D-8500 Nürnberg 60, Fed. Rep. of Germany

[21] Appl. No.: 446,256

[22] Filed: Dec. 5, 1989

[30] Foreign Application Priority Data

Dec. 12, 1988 [DE] Fed. Rep. of Germany ..... 3841789

[51] Int. Cl.[5] ..... C25D 17/20

[52] U.S. Cl. ..... 204/213

[58] Field of Search ..... 204/213

[56] References Cited

U.S. PATENT DOCUMENTS 2,741,463 4/1956 Colclesser ..... 204/213

OTHER PUBLICATIONS

Leaflet of Richard Tscherwitschke GmbH, "Barrel and Superstructure Assemblies for Electroplating, Phosphating and Pickling", Apr. 1982; Richard Tscherwitschke GmbH, Kunststoff-Apparatebau und Abluft-technik, Dieselstrasse 21, 7022 Lein.-Echterdingen.

*Primary Examiner*—T. M. Tufariello

*Attorney, Agent, or Firm*—Browdy and Neimark

[57] ABSTRACT

A rotatable barrel has end faces, support bars connecting the end faces parallel to a central longitudinal axis, and barrel coat sections in each case provided between two neighboring support bars. The barrel coat sections are provided with openings for the passage of a treatment bath solution for the treatment of a charge of small pieces in the inner room of the barrel. The barrel coat sections are each formed by two partial sections, which are roof-shaped forming a vertex. They enclose a vertex angle of between 90° and 180°, preferably between 110° and 130°, towards the inner room. The support bars may project into the inner room as conveying bars.

16 Claims, 5 Drawing Sheets

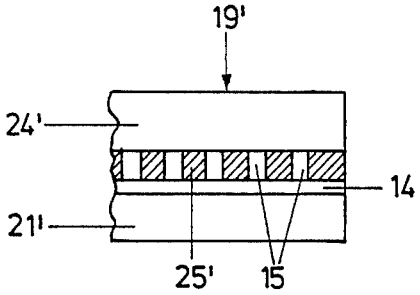
FIG. 3
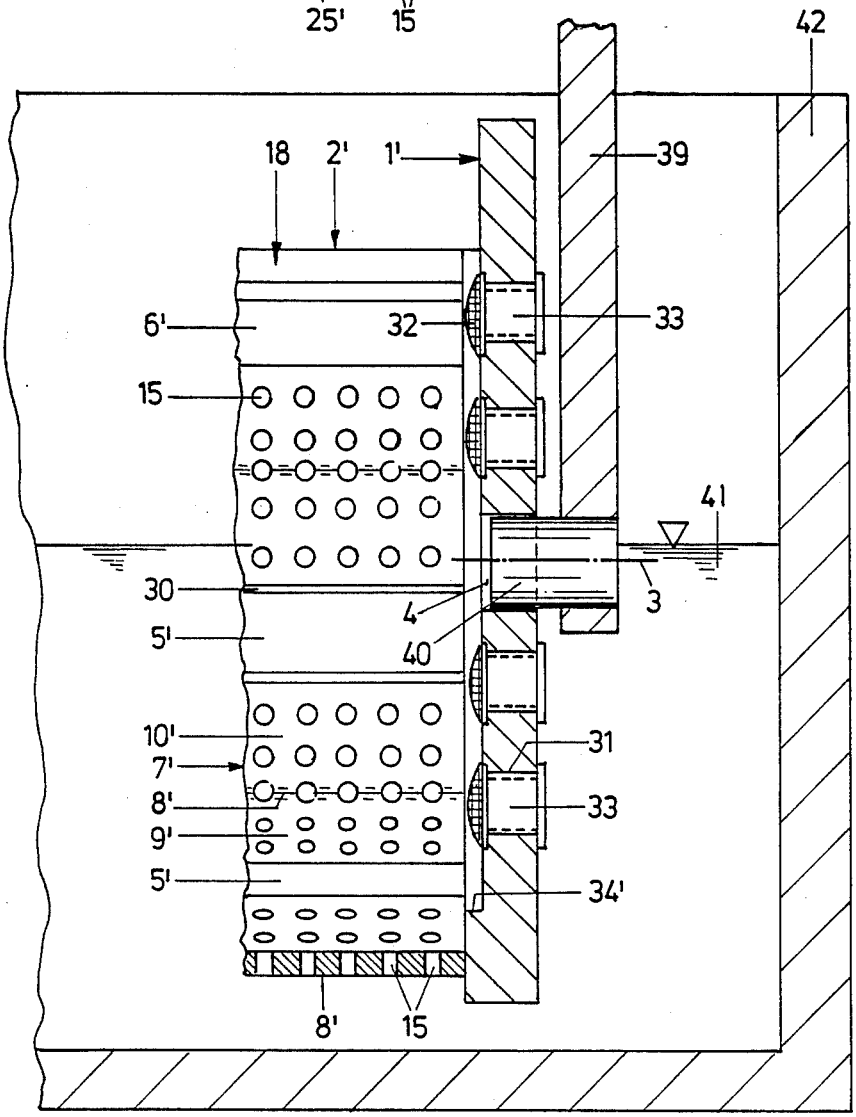

BARREL FOR ELECTROPLATING, PHOSPHATING AND PICKLING

FIELD OF THE INVENTION

The invention relates to a rotatable barrel of an electrically non-conductive plastics material for the surface treatment of pourable small pieces in a treatment bath solution with two end faces spaced apart, with a central longitudinal axis, with support bars arranged parallel to each other and to the central longitudinal axis, which are connected with the end faces, with barrel coat sections, which are arranged each between two adjacent support bars and which are connected with them, the support bars and the barrel coat sections forming one barrel coat with an inner wall, with at least one charge and discharge opening in the barrel coat, with at least one cover for closing the at least one charge and discharge opening, the end faces, the barrel coat and the at least one cover delimiting an inner room taking up a charge of small pieces, with openings for the passage of the treatment bath solution provided at least in the barrel coat sections, and with rotatable bearing devices arranged adjacent to the end faces and concentrically to the central longitudinal axis.

BACKGROUND OF THE INVENTION

A barrel of this kind is known from the leaflet of Richard Tscherwitschke GmbH, "Barrel and Superstructure Assemblies for Electroplating, Phosphating and Pickling". In such barrels charges of small metal pieces are immersed in acid or alkaline aqueous solutions, namely treatment bath solutions, where they are treated chemically or electrolytically. As a rule they stay in the treatment bath solution for at least 30 minutes, during which time they are driven at a speed of rotation of approximately 10 rpm. On this occasion a slippage results between the charge of small pieces and the inner wall of the barrel, since due to its dead weight the charge slides downwards on the inner wall of the barrel during its rotation. This gives rise to a considerable wear of the barrel coat sections, of the end faces and even of the support bars to the extent they are facing the inner room. Furthermore, the circulation movements of the individual pieces of the charge are irregular, so that a considerable scattering results during electrolytical treatment, i.e. electrolytical surface treatments, and also during chemical surface treatments, which extends the total treatment time.

SUMMARY OF THE INVENTION

It is an object of the present invention to embody a barrel of the generic type in such a way that the wear is reduced and the uniformity in treatment of the individual pieces is improved.

This object is attained in accordance with the invention by making the barrel coat sections roof-shaped by means of two partial sections forming a vertex and enclosing a vertex angle of more than 90° and less than 180°. Due to the modified shape of the barrel coat sections in accordance with the invention a relative movement of the charge vis-à-vis the barrel coat during its rotating movements is largely avoided, since the partial sections of the barrel coat sections engage with the charge like blades or like the teeth of a toothed gear and convey a corresponding quantity of small pieces upwards in the direction of rotation. A charge results having an oblique surface, in which the small pieces roll downwards, which in turn assures that even the small pieces inside the charge come to the surface and, in particular, reach the inner wall of the barrel coat, so that a uniform admittance of the treatment bath solution is realized, with a more uniform treatment, i.e. a more uniform coating as the case may be, being achieved in the case of a purely chemical treatment on the one hand, but also in the case of an electrolytical treatment on the other hand.

The described conveying effect is even further improved, when the support bars project from the inner wall into the inner room in the way of conveying bars.

These conveying effects may even be further improved, when two neighbouring partical sections of adjacent barrel coat sections together enclose an angle of preferably 150° to 170°.

Further advantages and features of the invention will become apparent from the ensuing description of exemplary embodiment, taken in conjunction with the drawings.

BRIEF DESCRIPTION OF THE DRAWINGS

FIG. 3 is a vertical longitudinal part section taken through the barrel according to FIG. 2 with the positioning of the barrel in a container additionally indicated.

DESCRIPTION OF THE PREFERRED EMBODIMENTS

Figure 1:
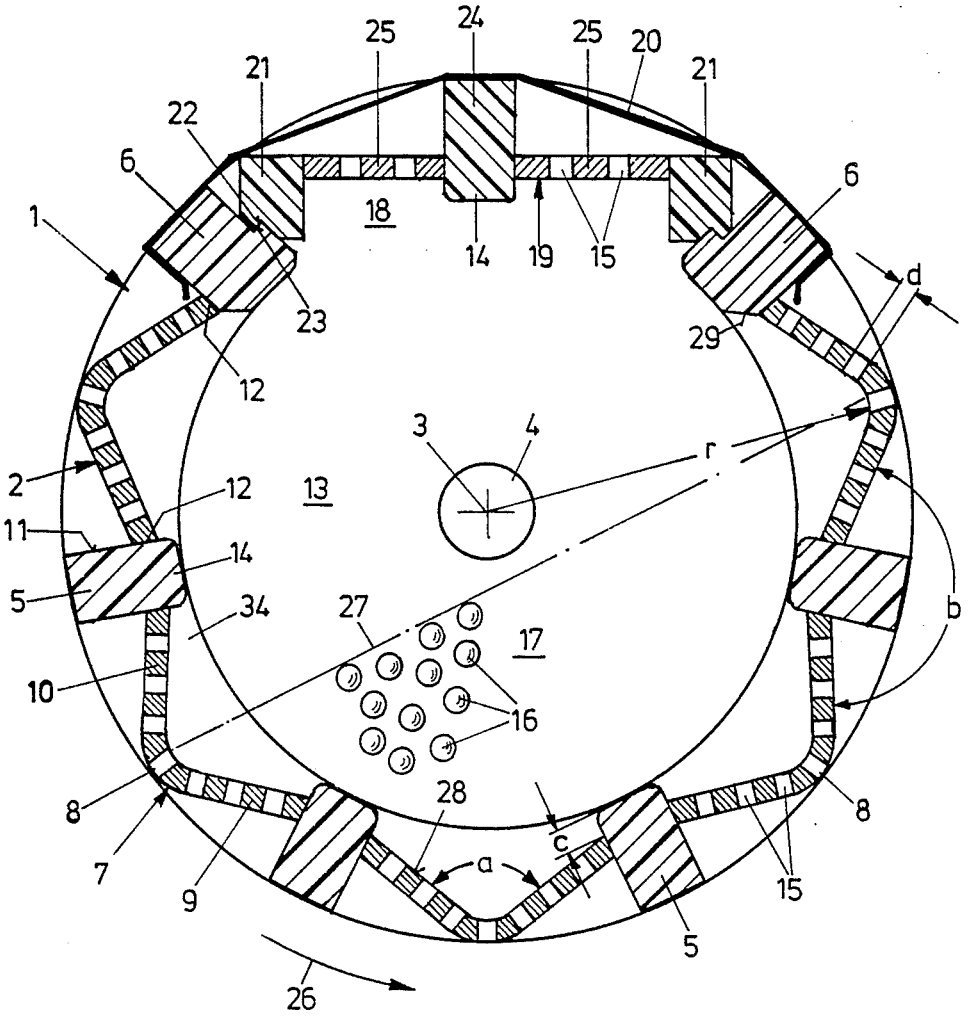
FIG. 1 is a vertical cross-section taken through a barrel.

The embodiment according to FIG. 1 shows a barrel consisting of two end faces 1, of which only one can be seen in the cross-sectional representation according to FIG. 1, and a barrel coat 2 extending between the two end faces 1. The barrel has a central longitudinal axis 3, around which it is rotatable. Bearing openings 4 are provided in the end faces 1 concentrically to the axis 3 taking up the bearing boss of holding devices, by means of which the barrels are held in electroplating pools. At this they are rotated around that axis 3. This is generally known practice for electroplating installations. The barrel coat 2 has a row of support bars 5, 6 spaced apart over the circumference of the in each case circular-disk-shaped end face 1. Barrel coat sections 7 having about the shape of a roof ridge with a vertex 8 are arranged each between two support bars 5, 5 and between two support bars 5, 6, but not between the two neighbouring support bars 6. The angle a enclosed inthe vertex 8 between. the two plane partial sections 9, 10 of each section 7 is larger than 90° and preferably amounts to 120°. The vertex 8 is parallel to the axis 3. The same is true for the partial sections 9, 10. The vertex 8 is located approximately at the circumference of the circular-disk-shaped end faces 1. Along a bonding surface 12 barrel coat sections 7 are connected by butt welding with the side walls 11 of the support bars 5, 6, which side walls 11 extend about radially to the axis 3. As can be seen in FIG. 1, the partial sections 9 and 10 of two neighbouring barrel coat sections 7 are secured to the same support bar 5 not in alignment, but they are bent outward at an angle b smaller than 180° and preferably of 150° to 170°, in particular about 165°.

The support bars 5, 6 project from the bonding surfaces 12 into the inner room 13 of the barrel there forming conveying bars 14. These extend over a length c from the bonding surfaces 12 radially towards the axis 3, which length c amounts to approximately 3 to 7% of the maximum inner diameter r of the barrel.

The barrel coat sections 7 are provided with openings 15 all over thier surface, the diameter of which is clearly smaller than the corresponding smallest diameter of the pieces 16 to be treated in the barrel and with which such a barrel is filled to about one third of its volume and which thus form a charge 17.

After the loading of the barrel with a charge 17 of small pieces 16 a charge and discharge opening 18 provided between the two support bars 6 is closed with a cover 19 which is secured by resilient fastening clamps 20 slipped over the cover 19 and both support bars 6.

The cover 19 has two longitudinal braces 21 which are parallel to the axis 3 and which have projecting abutting surfaces 23 of the support bars 6 limiting the opening 18. Furthermore the cover 19 has a central longitudinal brace 24 arranged between the two lateral longitudinal braces and simultaneously serving as a handle. It has a section projecting inwards as a conveying bar 14. A barrel coat section 25, which is equally provided with openings 15 and which is connected with the longitudinal braces 21, 24 along bonding surfaces 12 by butt welding, is arranged between each lateral longitudinal brace 21 and the central longitudinal brace 24.

When the barrel is rotated about its axis 3 in the direction of rotation 26, the charge 17 takes approximately a slope position with a surface 27 as shown in FIG. 1. During rotation the individual small pieces 16 of the charge 17 are taken along without any slippage due to the roof-shaped or ridge-shaped design of the barrel coat sections 7 and due to the conveying bars 14, i.e. they do not slip off the inner wall 18 of the barrel coat 2 nor the end faces 1. Since there is not or only very little relative movement the charge 17 or the individual small pieces 16, respectively, and the inner wall 18, the wear of the barrel coat 2 and the end faces 1 is very low. Rather, the individual small pieces 16 substantially roll over the sloping surface of the charge 17 from the highest to the lowest point, thus coming close to the inner wall 28 of the barrel coat 2, which renders the plating effect particularly favourable. In order to facilitate the discharge of the barrel through the opening 18, inclined surfaces 29 extending from the bonding surfaces 12 to the opening 18 are provided at the support bars 6 limiting the opening 18.

Figure 2:
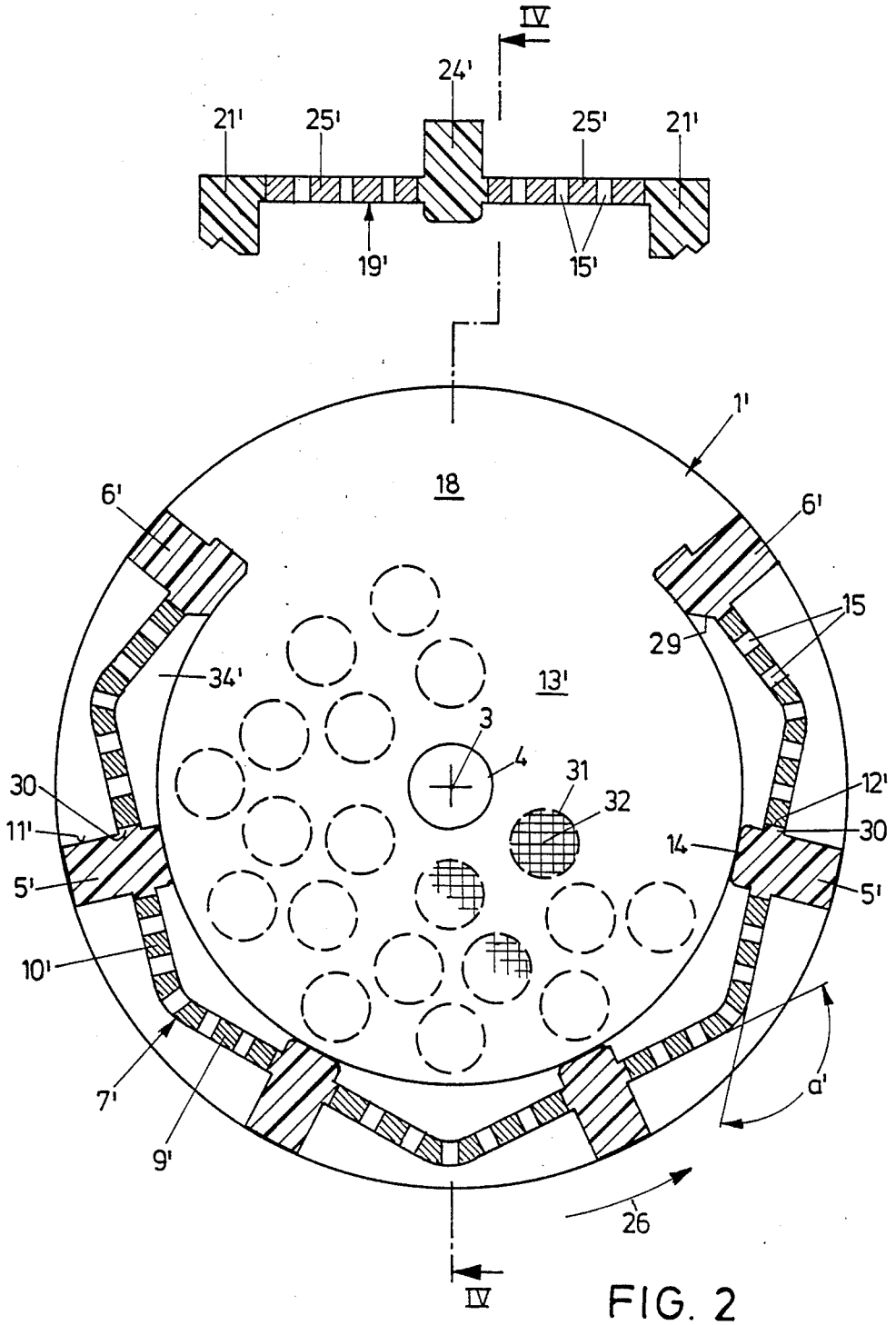
FIG. 2 is a vertical cross-section taken through a barrel in a slightly modified embodiment compared with FIG. 1 with the cover lifted.

The embodiment according to FIGS. 2 and 3 only slightly differs from the embodiment according to FIG. 1, so that the same parts have the same reference numbers as in FIG. 1 or constructively slightly modified parts have the same reference number as in FIG. 1, however provided with a prime, without a new description being necessary.

The support bars 5' and 6' have shoulders 30 on their side wall 11', to which the barrel coat sections 7' are butted and butt welded, i.e. fusion welded. The bonding surfaces 12' are thus formed between these shoulders 30 and the sections 7'.

as can be seen from FIG. 2, the two partial sections 9', 10' of two sections 7', which are connected by a support bar 5', are in alignment. Thus the vertex angle a' between the two partial sections 9', 10' of a barrel coat section 7' is smaller then in the case of the embodiment according to FIG. 1, while apart from that the size and arrangement of the support bars 5', 6' is the same as the arrangement of the support bars 5, 6 of the embodiment according to FIG. 1. It amounts in this case to about 130°.

Further, according to this embodiment a larger number of passage openings 31 is provided in each end face 1', through which the entering of a treatment bath solution into the inner room 13' and its flowing out from the same is made possible. The number of such passage opening 31 is only limited by the required stability of the specific end face 1'. The passage openings 31 are closed by screens 32 secured to elastic sleeves 33 which are locked into place in the openings 31. Such openings 31 with screens 32 may of course be provided in the same manner in the embodiment according to FIG. 1, but to simplify matters they are not shown there.

FIG. 3 also shows that the support bars 5', 6' are butted to a projecting edge 34' of the respective end face 1' by butt welding, i.e. fusion welding. In the embodiment according to FIG. 1 the corresponding edge 34 serves to this purpose.

Figure 4:
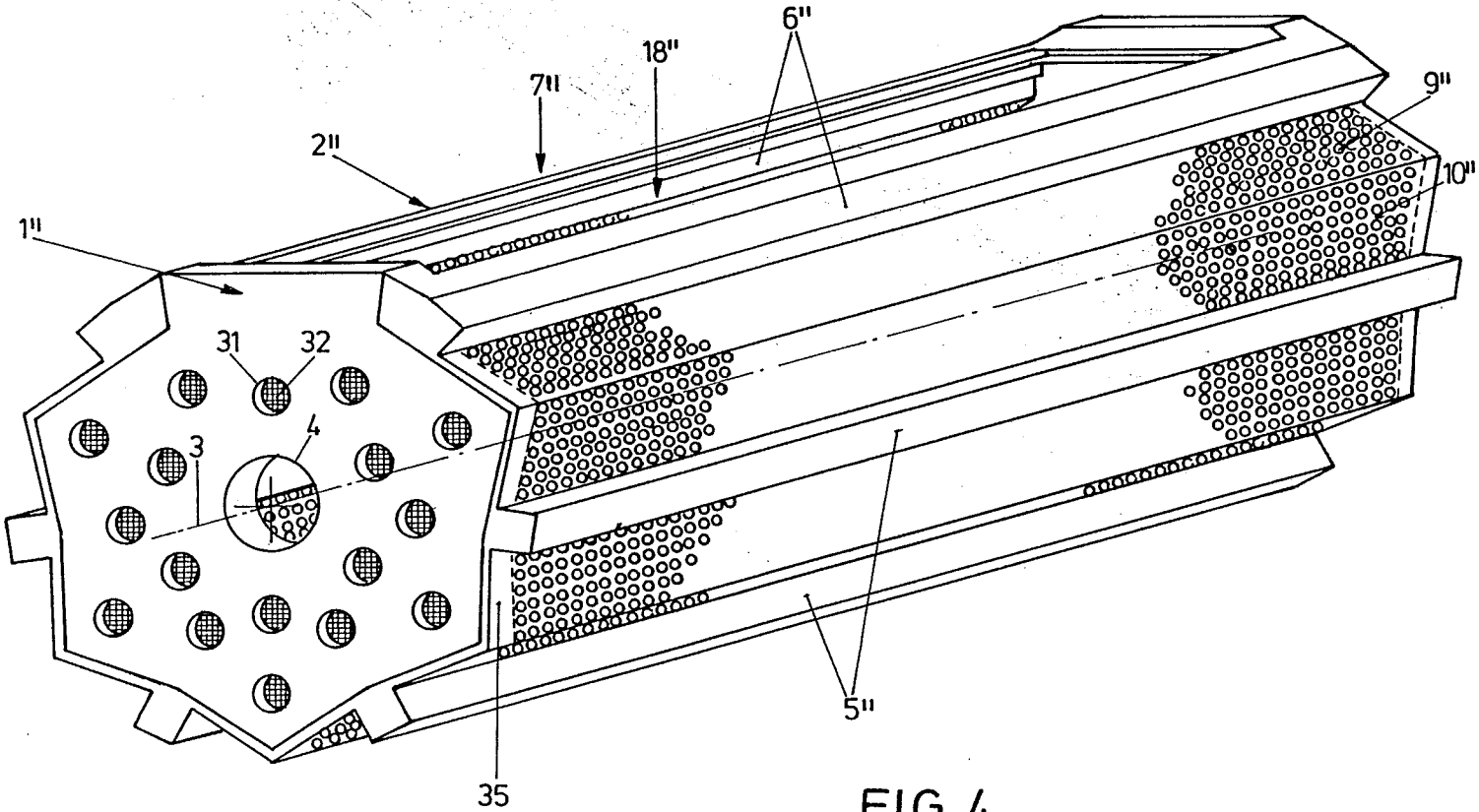
FIG. 4 is a perspective view of a further modified embodiment of a barrel.

In the embodiment according to FIG. 4 support bars 5'', 6'' and corresponding barrel coat sections 7'' are not secured with their ends to corresponding circular-disk-shaped and faces 1 or 1', but they are secured to the outer circumference 35 of the end faces 1'' by means of butt welding, i.e. fusion welding. These end faces 1'' therefore have a cross-sectional profile corresponding to the cross-sectional profile of the barrel coat 2''. Apart from that the same is true for the details of the barrel according to FIG. 4 as for the representation according to FIGS. 1 to 3.

Figure 5:
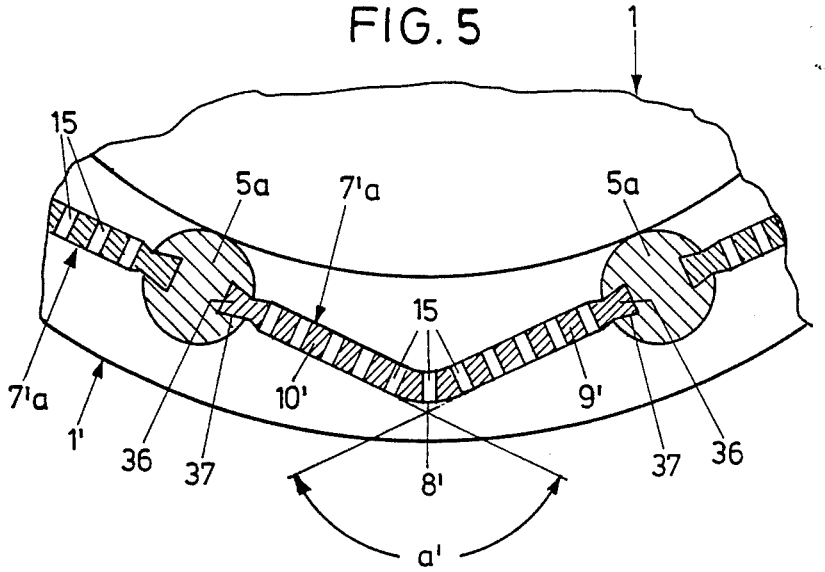
FIG. 5 is a part cross-section taken through a further modified embodiment of a barrel.

In the embodiment according to FIG. 5 the side of the barrel cost sections 7'*a* to be connected with a corresponding support bar 5*a* is provided with a dovetail profile 36, which is slid into a corresponding dovetail groove 37 in the support bar 5*a*. Such a design is reasonable and effective when the barrel coat sections 7'*a* consist of a non-weldable plastics material, such as an extremely high-molecular polyethylene. In this case the barrel coat section 7'*a* is thermoplastically deflected, i.e. bent. The support bars 5*a* are designed as cylinder profiles and secured to the respective end face 1' by butt welding. To the extent FIG. 5 contains reference numbers which have already been used, the afore-mentioned statements apply.

Figure 6:
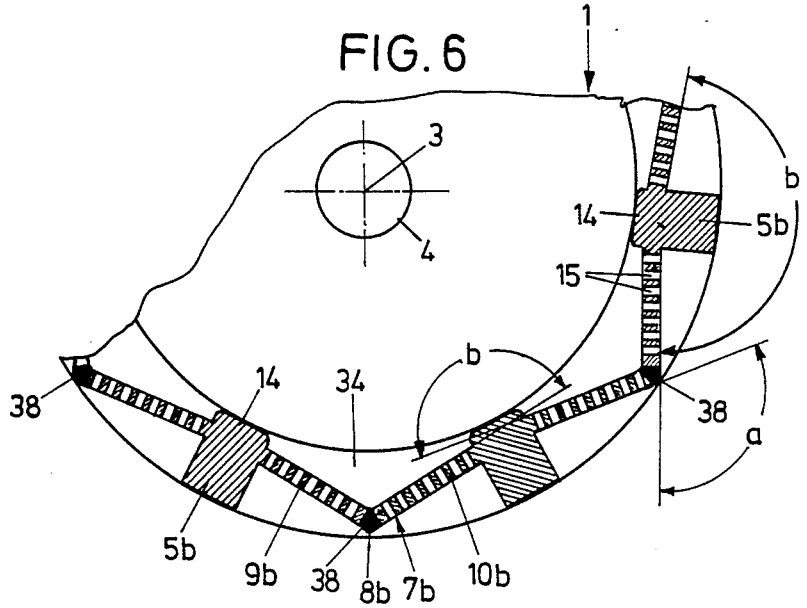
FIG. 6 is a part cross-section taken through a further modified embodiment of a barrel.

In the embodiment according to FIG. 6 each support bar 5*b* is designed to form one piece with two partial sections 9*b*, 10*b* of a barrel coat section 7*b* joined to both of its sides. In this case two partial sections 9*b*, 10*b* forming a barrel coat section 7*b* are in each case connected with one another by means of a welding seam 38 adjacent to the vertex 8*b*. This welding seam 38 may for example be produced in an extrusion welding system. Apart from that the design of this barrel is the same as in the embodiment according to FIG. 1. To this extent the same reference numbers as in FIG. 1 are used for a number of parts shown with a b being added in the case of constructive deviations.

FIG. 3 indicates that a barrel of the different designs represented and described is held by bearing braces 39 in a conventional and known manner, which, from above and outside, partially project from the end faces 1 or 1' or 1'', respectively. These bearing braces 39 each have a central pivot 40 reaching into the corresponding bearing opening 4. For the performance of a treatment process of the small pieces 16 the barrel is suspended in a container 42 open at the top and filled with a treatment bath solution 41 and is rotated for the performance of the process.

In particular due to their especially good wear properties a high-molecular polyethylene or an extremely high-molecular polyethylene are possible as weldable material for the end faces, the support bars and the barrel coat sections in particular due to their especially good wear properties.

What is claimed is:

1. A rotatable barrel of an electrically non-conductive plastics material for the surface treatment of pourable small pieces (16) in a treatment bath solution (41), comprising:

two end faces (1, 1', 1'') spaced apart from each other; a central longitudinal axis (3);

support bars (5, 6; 5', 6'; 5'', 6''; 5*a*; 5*b*) arranged parallel to each other and to said central longitudinal axis (3), which are connected with said end faces (1, 1', 1'');

barrel coat sections (7, 7', 7'', 7'*a*, 7*b*), which are arranged each between two adjacent support bars (5, 6; 5', 6'; 5'', 6''; 5*a*; 5*b*) and which are connected with them, said support bars (5, 6; 5', 6'; 5'', 6''; 5*a*; 5*b*) and said barrel coat sections (7, 7', 7'', 7'*a*, 7*b*) forming one barrel coat (2, 2', 2'') with an inner wall (28);

at least one charge and discharge opening (18, 18'') in said barrel coat (2, 2', 2'');

at least one cover (19, 19') for closing said at least one charge and discharge opening (18, 18'');

an inner room (13, 13') delimited by said end faces (1, 1', 1''), said barrel coat (2, 2', 2'') and said at least one cover (19, 19'), and taking up a charge (17) of said small pieces (16);

openings (15) for the passage of said treatment bath solution (41) provided at least in said barrel coat sections (7, 7', 7'', 7'*a*, 7*b*); and rotatable bearing devices (4) arranged adjacent to said end faces (1, 1', 1'') and concentrically to said central longitudinal axis (3);

wherein said barrel coat sections (7, 7'', 7'', 7'*1*, 7*b*) are made roof-shaped by means of two partial sections (9, 10; 9', 10'; 9'', 10''; 9*b*, 10*b*) forming a vertex (8, 8', 8*b*) and enclosing a vertex angle (a, a') of more than 90° and less than 180°.

2. A barrel according to claim 1, wherein the vertex angle (a, a') is smaller than 130° and larger than 110°.

3. A barrel according to claim 2, wherein the vertex angle (a, a') is approximately 120°.

4. A barrel according to claim 1, wherein the support bars (5, 6; 5', 6'; 5''; 6''; 5*a*; 5*b*) project from the inner wall (28) into the inner room (13, 13') as conveying bars (14).

5. A barrel according to claim 4, wherein the conveying bars (14) project into the inner room (13, 13') over a length (c), which is about 3 to 7% of a largest inner diameter (r) of the barrel coat (2, 2', 2'').

6. A barrel according to claim 1, wherein, in each case, two neighbouring partial sections (9', 10') of adjacent barrel coat sections (7', 7'*a*) are in alignment.

7. A barrel according to claim 1, wherein, in each case, two neighbouring partial sections (9, 10; 9*b*, 10*b*) of adjacent barrel coat sections (7, 7*b*) enclose an angle (b) of 150° to 170°.

8. A barrel according to claim 1, wherein the partial sections (9, 10; 9', 10'; 9'', 10''; 9*b*, 10*b*) are plane.

9. A barrel according to claim 1, wherein the barrel coat sections (7, 7', 7'', 7'*a*) are secured to side walls (11) of the support bars (5, 6).

10. A barrel according to claim 1, wherein the barrel coat sections (7) are secured to side walls (11) of the support bars (5, 6).

11. A barrel according to claim 1, wherein the barrel coat sections (7') are secured to shoulders (30) projecting from side walls (11') of the support bars (5', 6').

12. A barrel according to claim 1, wherein the barrel coat sections (7, 7', 7'') are butt welded to bonding surfaces (12, 12') of the support bars (5, 6; 5', 6'; 5'', 6'').

13. A barrel according to claim 1, wherein the barrel coat sections (7'*a*) are positively connected with the support bars (5*a*).

14. A barrel according to claim 13, wherein the barrel coat sections (7'*a*) and the support bars (5*a*) are connected with each other by means of dovetail profiles (36).

15. A barrel according to claim 1, wherein, in each case, two neighbouring partial sections (9*b*, 10*b*) of adjacent barrel coat sections (7*b*) are formed in one piece with each support bar (5*b*) provided between the adjacent barrel coat sections (7*b*) and wherein two neighbouring partial sections (9*b*, 10*b*) forming one barrel coat section (7*b*) are connected with each other.

16. A barrel according to claim 15, wherein the partial sections (9*b*, 10*b*) are connected with each other by means of a welding seam (38).

* * * * *